United States Patent [19]

McGahan

[11] Patent Number: 4,511,946

[45] Date of Patent: Apr. 16, 1985

[54] PROGRAMMABLE COMBINATION ELECTRONIC LOCK

[75] Inventor: Wallace A. McGahan, Lawrenceville, N.J.

[73] Assignee: Schlage Lock Company, San Francisco, Calif.

[21] Appl. No.: 457,965

[22] Filed: Jan. 14, 1983

[51] Int. Cl.[3] ..... H01H 47/28

[52] U.S. Cl. ..... 361/172; 340/825.31; 70/278

[58] Field of Search ..... 361/171, 172; 340/542, 340/825.31; 70/277, 278; 307/10 AT

[56] References Cited

U.S. PATENT DOCUMENTS

| | | | |
|---|---|---|---|
| 3,821,704 | 6/1974 | Sabsay | 340/825.31 X |
| 4,148,092 | 4/1979 | Martin | 361/172 |
| 4,177,657 | 12/1979 | Aydin | 70/278 |
| 4,347,545 | 8/1982 | Weishaupt et al. | 361/172 |

*Primary Examiner*—Reinhard J. Eisenzopf

*Attorney, Agent, or Firm*—W. C. Vliet

[57] ABSTRACT

An operating scheme for electronic locks wherein both the key and the lock have a first and second combination. The lock will open when the first key combination equals the first lock combination and the second key combination equals the second lock combination. The lock recombinates to the first key combination and the second key combination when the first key combination equals the second lock combination.

8 Claims, 2 Drawing Figures

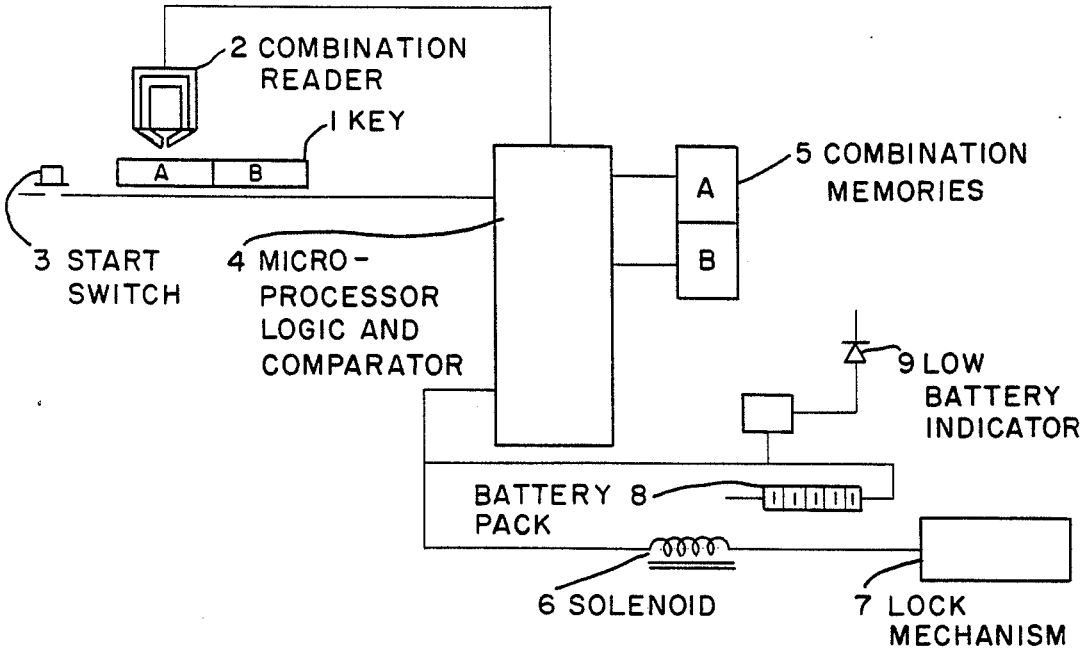

FIG. 1

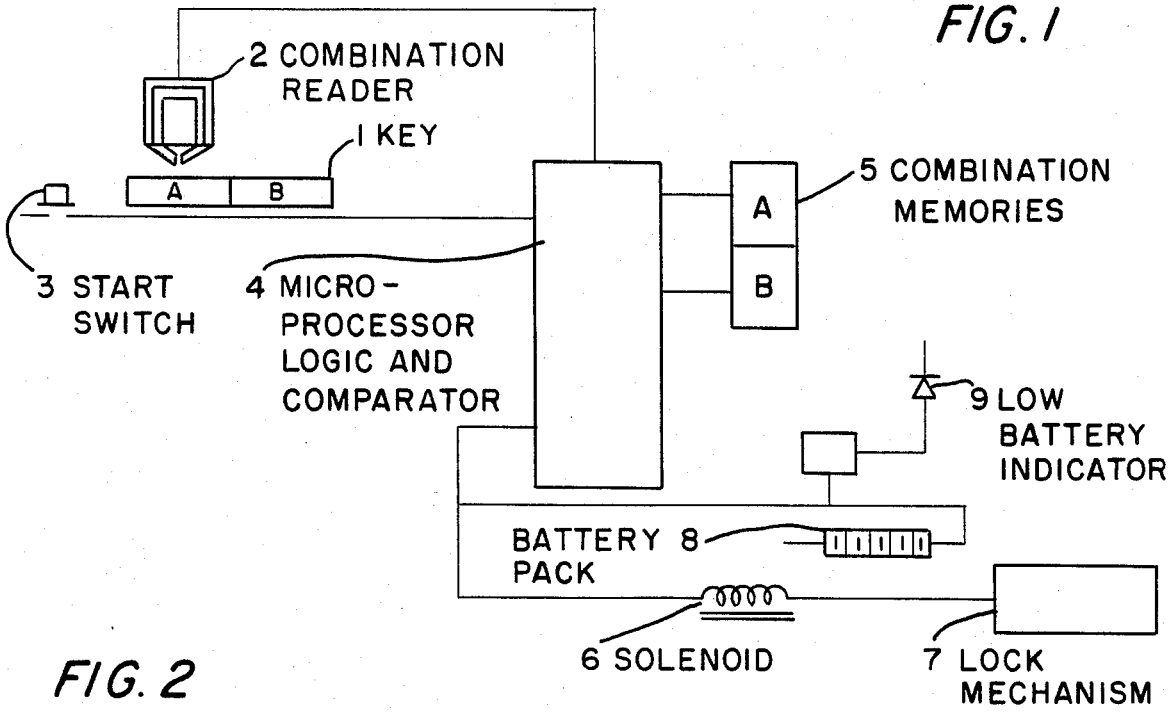

FIG. 2

| | START | LOCK BEFORE | LOCK AFTER |
|---|---|---|---|
| KEY | FIRST $N_1$, SECOND $N_2$ | FIRST $N_1$, SECOND $N_2$ | FIRST $N_1$, SECOND $N_2$ |
| POTENTIAL INTRUDER | FIRST $N_2$, SECOND $N_3$ | FIRST $N_1$, SECOND $N_2$ | FIRST $N_2$, SECOND $N_3$ |
| NEXT RENTER | FIRST $N_3$, SECOND $N_4$ | FIRST $N_2$, SECOND $N_3$ | FIRST $N_3$, SECOND $N_4$ |
| INTRUDER OLD KEY | FIRST $N_2$, SECOND $N_3$ | FIRST $N_3$, SECOND $N_4$ | FIRST $N_3$, SECOND $N_4$ |
| REVISED KEY | SECOND $N_3$, FIRST $N_2$ | FIRST $N_3$, SECOND $N_4$ | FIRST $N_3$, SECOND $N_4$ |
| PRIOR ART | SECOND $N_3$, FIRST $N_2$ | FIRST $N_3$, SECOND $N_4$ | FIRST $N_3$, SECOND $N_2$ |

PROGRAMMABLE COMBINATION ELECTRONIC LOCK

BACKGROUND OF THE INVENTION

Operating schemes for electronic locks intended for hotel or motel applications and the like are known in the art. This invention reveals a new scheme which differs from the known concepts and improves the security thereof.

OBJECT OF THE INVENTION

The object of this invention is to provide a system of high level security for electronic lock combination schemes which recombinate with each subsequent user.

This and other objects are obtained in a method of combinating an electronic lock comprising the steps of: providing a key with a first and second combination, and a lock with a first and second stored combination, reading the first and second combination on the key and comparing the first key combination with the first lock combination and the second key combination with the second lock combination, and opening the lock in a first mode of operation in response to the first key combination equaling the first lock combination and the second key combination equaling the second lock combination, and in a second mode of operation, recombinating the first and second lock combinations respectively to the first and second key combinations if the first key combination equals the second lock combination, and opening the lock.

BRIEF DESCRIPTION OF THE DRAWINGS

FIG. 1 is a schematic drawing of the components of a lock system according to the present invention.

FIG. 2 is a use example of how the method logic of the invention works.

DESCRIPTION OF THE PREFERRED EMBODIMENT

In my invention, the key has two different coded combination numbers on it, one in a first position and a second in a second position. The lock also has two different stored coded combination numbers, one in a first position relating to the first key position, and one in a second position relating to the second key position.

The combinations stored on the key and in the lock may take the form of any number of digits, letters, or other coded bits. It is intended merely that the combinations be discreet and capable of being placed in a first and a second position and in a stored lock memory for comparison. A random combination is preferred and it is intended that each subsequent key combination be different as described, the number of potential combinations being limited by the number of individual bits in the combination.

Use of the key in the lock produces the following results. If key code first equals lock code first and key code second equals lock code second, the lock will open. If key code first equals lock code second, the lock will recombinate to key code first in the first lock position and key code second in the second lock position and the lock will open. In this case, all prior keys will be unable to operate the lock.

Referring to FIG. 1, a schematic drawing of an electronic lock according to the present invention is shown. A key 1 having a first combination code A in a first position and a second combination code B in a second position is inserted in a combination reader 2. It should be understood that for purposes of the invention the card and reader may be of any known data store and read form, such as a magnetic strip card and reader, punched card and punch card reader, optical code and optical code reader, or the like.

In the embodiment shown, insertion of the key card to be read, actuates start switch 3 which in turn activates the card combination reader 2 and the logic microprocessor and comparator 4. The card combinations are read by the combination reader 2 and sent to the logic device 4 for comparison to the combinations stored in the constantly active combination memory 5 in a first and second position. If the first key code equals the first lock code and the second key code equals the second lock code, the logic 4 will actuate the solenoid 6 through a suitable switch (not shown). The solenoid 6 will in turn release the lock mechanism 7 in a convenient manner (not shown), not critical to the operating scheme.

A battery pack 8 supplies power to the electronic combination lock to power its functions. It should be understood that the lock may be hard wired for utility power. A low battery power indicator light 9 is provided to warn of dangerously low battery power.

The start switch 3 conserves battery power by actuating the system read and compare function only when a key is present and for a short time thereafter to read the key card and operate the lock.

FIG. 2 illustrates the sequence of combination numbers that would appear on the key and in the lock in a hypothetical sequence involving a potential intruder.

For example, let's assume at the start that a key has a first combination N1 and a second combination N2, and that the lock likewise has the same stored combinations in its first position of N1, and in its second position of N2. Continued use of the starting key will open the lock because the first combination of the key equals the first combination of the lock, and the second combination of the key equals the second combination of the lock.

Assuming the next renter is a potential intruder, he would receive a key from the desk control having the numbers N2 and N3 respectively on the key. When the potential intruder inserts the key in the lock, the lock will recombinate to N2 in the first position and N3 in the second position because the combination in the first position of the key, N2, equalled the stored combination, N2, in the second position of the lock. The door would open and any subsequent use of the key by the potential intruder would open the door.

The next renter would receive a key having combination N3 in the first position and combination N4 in the second position. As before, use of this key would recombinate the lock to N3 in the first position and N4 in the second position. Now if the potential intruder attempts to use his old key, he would find himself locked out because neither the first nor second combination of the key equals the first or second stored combination in the lock respectively. Also, the first combination of the key does not equal the second stored combination in the lock, so the lock will not recombinate.

Even if the intruder were to somehow revise his key to reverse the key combinations, he could not reenter the room because he lacks the critical combination N4.

In one of the prior art schemes, the lock would open if the first key combination equaled either the first or second stored lock combination. It should be obvious that with this prior art situation, the intruder's revised key would work because the first combination in the key equals the first stored combination. This shortcoming is overcome in the present invention by requiring the dual comparison to open the lock.

Having described my invention in terms of a preferred embodiment, it will now be obvious to one skilled in the art that numerous modifications such as power switching, function indicators, and master level or parallel combinations for room service and the like, are possible with this operating scheme and I do not wish to be limited in the scope of my invention except by the scope of the claims.

I claim:

1. A method for combinating electronic locks by sequential users comprising the steps of:

providing a key with a first and second combination;

providing a lock with a first and second stored combination;

reading said first and second combinations on said key and comparing said first key combination with said first lock combination and said second key combination with said second lock combination; and opening said lock in a first mode of operation by a former repeat user in response to said first key combination equaling said first lock combination and said second key combination equaling said second lock combination; and in a second mode of operation by a new user, comparing said first key combination with said second lock combination and recombinating said first and second lock combination respectively to said first and second key combination if said first key combination equals said second lock combination and opening the lock.

2. An electronic lock which recombinates with each subsequent new user comprising:

a key having a first and second combination;

a lock having a first and second stored combination;

means for reading said first and second key combinations and comparing them respectively to said first and second stored lock combinations;

means for opening said lock in response to said comparison, said first key combination being equal to said first lock combination and said second key combination being equal to said second lock combination;

means for comparing said first key combination with said second lock combination; and means for recombinating said first and said second stored lock combinations to said first and second key combinations respectively in response to said first key combination being equal to said second lock combination and opening said lock.

3. An electronic lock according to claim 2 wherein said means for opening said lock further comprises an electronically operated solenoid.

4. An electronic lock according to claim 2 wherein said means for reading said first and second key combinations comprises a magnetic strip reader and decoder to compare the reading on a magnetic strip key card with said stored lock combination.

5. An electronic lock according to claim 2 wherein said means for reading said first and second key combinations comprises a punched card reader and decoder to compare the reading on a punched card with said stored lock combination.

6. An electronic lock according to claim 2 wherein said means for reading said first and second key combinations comprises an optical reader and decoder to compare the reading on an optically encoded card with said stored lock combination.

7. An electronic lock according to claim 2 which is battery powered for remote and independent operation.

8. An electronic lock according to claim 2 wherein said first and said second stored lock combinations are retained in a constant active memory and the remainder of the lock function is instituted only on insertion of a key for the purpose of conserving power and promoting component life.

* * * * *